US005613528A

United States Patent [19]

Zenoni et al.

[11] Patent Number: 5,613,528

[45] Date of Patent: Mar. 25, 1997

[54] DEVICE AND METHOD FOR MONITORING THE THREAD RESERVE IN WEFT FEEDERS

[75] Inventors: Pietro Zenoni, Leffe; Luca Gotti, Albino, both of Italy

[73] Assignee: L.G.L. Electronics S.p.A., Bergamo, Italy

[21] Appl. No.: 555,694

[22] Filed: Nov. 14, 1995

[30] Foreign Application Priority Data

Nov. 22, 1994 [IT] Italy ..... TO94A0935

[51] Int. Cl.[6] ..... D03D 47/36

[52] U.S. Cl. ..... 139/452; 242/47.01

[58] Field of Search ..... 139/452; 242/47.01

[56] References Cited

U.S. PATENT DOCUMENTS 4,617,971 10/1986 Hellstroem ..... 139/452
4,716,943 1/1988 Yoshida et al. ..... 139/452
5,117,865 6/1992 Lee ..... 139/383 A
5,377,922 1/1995 Fredriksson et al. ..... 139/452

*Primary Examiner*—Andy Falik
*Attorney, Agent, or Firm*—Guido Modiano; Albert Josif

[57] ABSTRACT

A weft feeder comprising weft sensors with movable magnetic elements that cooperate with respective detectors located outside the feeder drum; the detectors react with a signal, without contact, when the position of the corresponding weft sensor changes. Each detector in turn comprises an acquisition sensor capable of providing an analog signal, in terms of voltage, that can vary in a linear manner as the angular positions of the movable magnetic elements of the weft sensors vary. The acquisition sensors are operatively connected to a microprocessor for controlling the motor of the feeder, which is programmed to automatically set the values of the weft presence threshold and of the weft absence threshold and to filter the values of said signals.

11 Claims, 3 Drawing Sheets

DEVICE AND METHOD FOR MONITORING THE THREAD RESERVE IN WEFT FEEDERS

BACKGROUND OF THE INVENTION

The present invention relates to an improved device and method for monitoring the thread reserve in devices for feeding weft to looms and textile machines in general.

More particularly, the invention relates to conventional weft feeders comprising a fixed drum on which a windmilling rotating arm winds a plurality of turns of thread constituting a reserve of weft, in which the turns of the reserve are unwound in a preset amount at each beat of the loom, and in which sensor means are provided which are capable of starting and stopping the motor that actuates the windmilling arm when the thread reserve drops below a preset number of turns and, respectively, when the reserve has been fully restored or if the thread breaks.

European patent no. 0 171 516 discloses a weft feeder of the specified type, in which the amount of thread reserve, which can vary between a minimum value and a maximum value, is monitored by means of at least one thread reserve sensor mounted in the fixed accumulation drum so as to be movable, in contrast with a return force, between a first position, which protrudes beyond the surface of the drum and in which the sensor is arranged when there are no turns of thread, and a second position, in which said sensor, actuated by the thread, is arranged at the same level as the surface of the fixed accumulation drum, and in which the sensor cooperates with a switching device located outside the accumulation drum and reacting with a signal, without contact, when the position of the sensor changes. Typically, the thread presence sensor is constituted by a permanent magnet and the switching device is sensitive to the variation in the magnetic field that occurs when the sensor passes from the first position to the second position and vice versa.

A drawback of this conventional system for monitoring the amount of weft reserve is the fact that the signal of the switching device can vary even significantly from one device to another, due both to the different relative position of the sensor and of the cooperating switching device and to the unavoidable variations in the parameters of the components, and this makes it difficult to calibrate the system and can cause false activations.

Another drawback is the fact that when the reserve of weft ends before the sensor, the turns that unwind from the drum strike said drum, causing it to move downwardly because of the limited contrast force applied thereto. These downward motions of the sensor cause a corresponding variation in the output signal of the switching device, which can be interpreted as a signal indicating that a reserve is present when this condition actually is not occurring. These false signals can easily lead the control system to unstable conditions, with the consequence that the feeding of the thread on the fixed drum of the feeder does not occur uniformly but is characterized by sudden accelerations and brakings that can easily break the thread.

SUMMARY OF THE INVENTION

The aim of the present invention is substantially to eliminate these and other drawbacks of the above-mentioned conventional devices for monitoring the amount of thread reserve, and said invention achieves this aim with an improved device and method for sensing the reserve of thread which have the features given in the appended claims.

Substantially, the invention is based on the use of one or more variable-configuration analog acquisition sensors capable of providing respective analog voltage signals that are proportional to the position of the corresponding weft sensors.

An improvement aimed at eliminating the first drawback mentioned above resides in the fact that, by using these analog signals, a self-calibration method is implemented on a microprocessor; said method consists in storing the maximum and minimum values of the output signals of the acquisition sensors, respectively in the absence and in the presence of weft, and in automatically setting, by means of said microprocessor, the values of the thresholds for weft thread presence or absence when the read signal is greater than the minimum signal increased by a preset percentage of the difference between said maximum and minimum values of the signal.

It is evident that this self-calibration method allows to sense with considerable precision the configuration of the acquisition sensor that is sensitive to the magnetic field produced by the thread sensor and therefore allows to make the thread presence and absence thresholds independent of the variations of said field.

Another improvement, aimed at eliminating the second one of said drawbacks, consists in processing, with an algorithm implemented on said microprocessor, the values of the voltage signals, read at the output of the sensors, in order to filter them and eliminate rapid variations of said signals.

As will become apparent from the following detailed description, said algorithm is based substantially on measuring the difference between the speed at which the thread reserve advances, during replenishment, on the weft feeder drum, and the much higher speed at which the thread is unwound from said drum and accordingly the variation time that affects said voltage signals as the reserve approaches, said time being much shorter than the variation time of said signals caused by the passage of one or more unwinding turns. Accordingly, a time margin is set which is comprised between a minimum value and a maximum value and is capable of discriminating the presence of the weft from the occasional transit of one or more turns.

BRIEF DESCRIPTION OF THE DRAWINGS

The characteristics, purposes, and advantages of the improved method and device according to the present invention will become apparent from the following detailed description and with reference to the accompanying exemplifying drawings, wherein.

DESCRIPTION OF THE PREFERRED EMBODIMENTS

Figure 1:
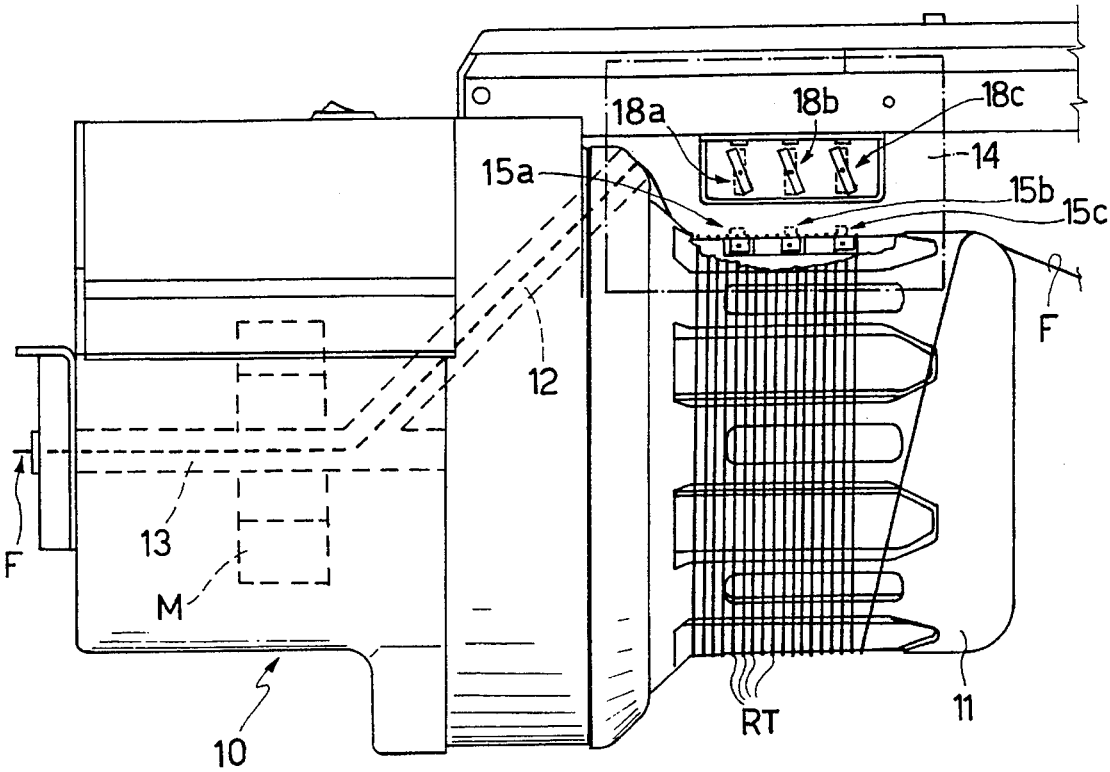
FIG. 1 is a partially sectional view of a weft feeder with which means for monitoring the weft reserve are associated.

With reference to the figures, the reference numeral 10 designates a weft feeder, which comprises a fixed drum 11 on which a hollow windmilling arm 12, driven by an equally hollow drive shaft 13, winds a plurality of turns of thread that constitute a reserve of weft RT that is partially unwound at each beat of the loom.

The reference numeral 14 generally designates a system for monitoring the reserve RT that is adapted to automatically actuate the motor M that drives the shaft 13, in order to wind new turns when the reserve drops to a preset lower limit and to stop said motor when the number of wound turns reaches a preset maximum value; the system is also capable of signalling the absence of the thread F in case of breakage. For this purpose, the monitoring system 14 is composed, in a per se known manner, of a set of three weft sensors 15*a*,15*b*,15*c* constituted by magnetic plates 16*a*, 16*b*,16*c* (FIG. 2), each of which is oscillatably mounted in the fixed drum 11 so as to be movable, in contrast with the action of a contrast means, for example an elastic one (not shown), from a first position, which protrudes beyond the surface S of the drum 11 and is shown in dashed lines in the figure, to a second position, in which said first plates are arranged at the same level as the surface S.

The first one of these positions of the plates is determined by the presence of the reserve of turns, and the second one is determined by the absence of said reserve and also by the passage of one or more unwinding turns, if the plate is arranged downstream of the final turn of the reserve relative to the unwinding motion of the thread.

According to an advantageous arrangement, the sensor 15*a* is located at the base of the drum 11 in order to signal the absence of thread, the sensor 15*b* is arranged approximately at the median section of the drum in order to signal the minimum reserve of thread, and the sensor 15*c* is arranged approximately at two thirds of the way along the drum to signal the maximum reserve of thread. Each one of the plates 16*a*,16*b*,16*c* cooperates, without direct contact, with a corresponding variable-configuration detector 18*a*, 18*b*,18*c*, capable of sensing the movements of the cooperating plates 16*a*,16*b*,16*c*, by emitting a corresponding analog signal in terms of voltage. For this purpose, the detectors comprise second oscillating magnetic plates 19*a*,19*b*,19*c* capable of assuming different angular positions lying between two extreme positions, which correspond to the first and second positions of the respective cooperating magnetic plates 16*a*, 16*b*,16*c*; said extreme positions are shown respectively in dashed lines and in solid lines so as to match the first and second positions of the plates 16.

Respective acquisition sensors 20*a*,20*b*,20*c* cooperate with the second oscillating plates 19*a*,19*b*,19*c* and are capable of supplying analog output signals U1,U2,U3 that can vary in a linear manner when the angular positions assumed by said second oscillating plates 19*a*,19*b*,19*c* vary.

According to one embodiment of the invention, the acquisition sensors 20*a*,20*b*,20*c* are constituted by Hall sensors, adapted to provide analog output signals that can vary in a linear manner and proportionally to the intensity of the magnetic field that is incident to their surface.

Figure 2A:
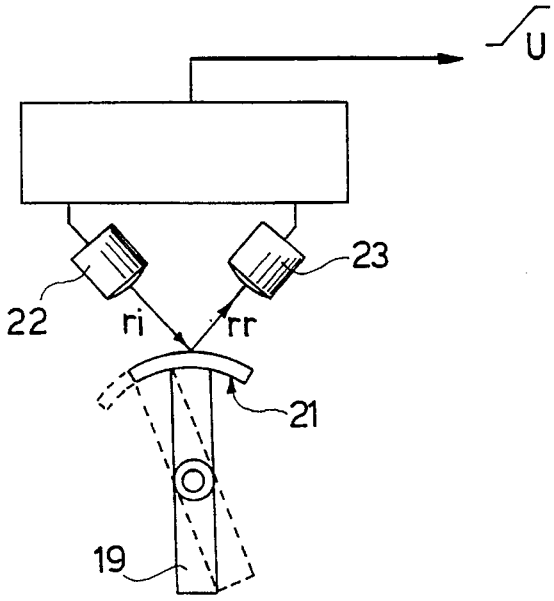
FIG. 2*a* is a constructive variation of the monitoring means of FIG. 2.
Figure 2:
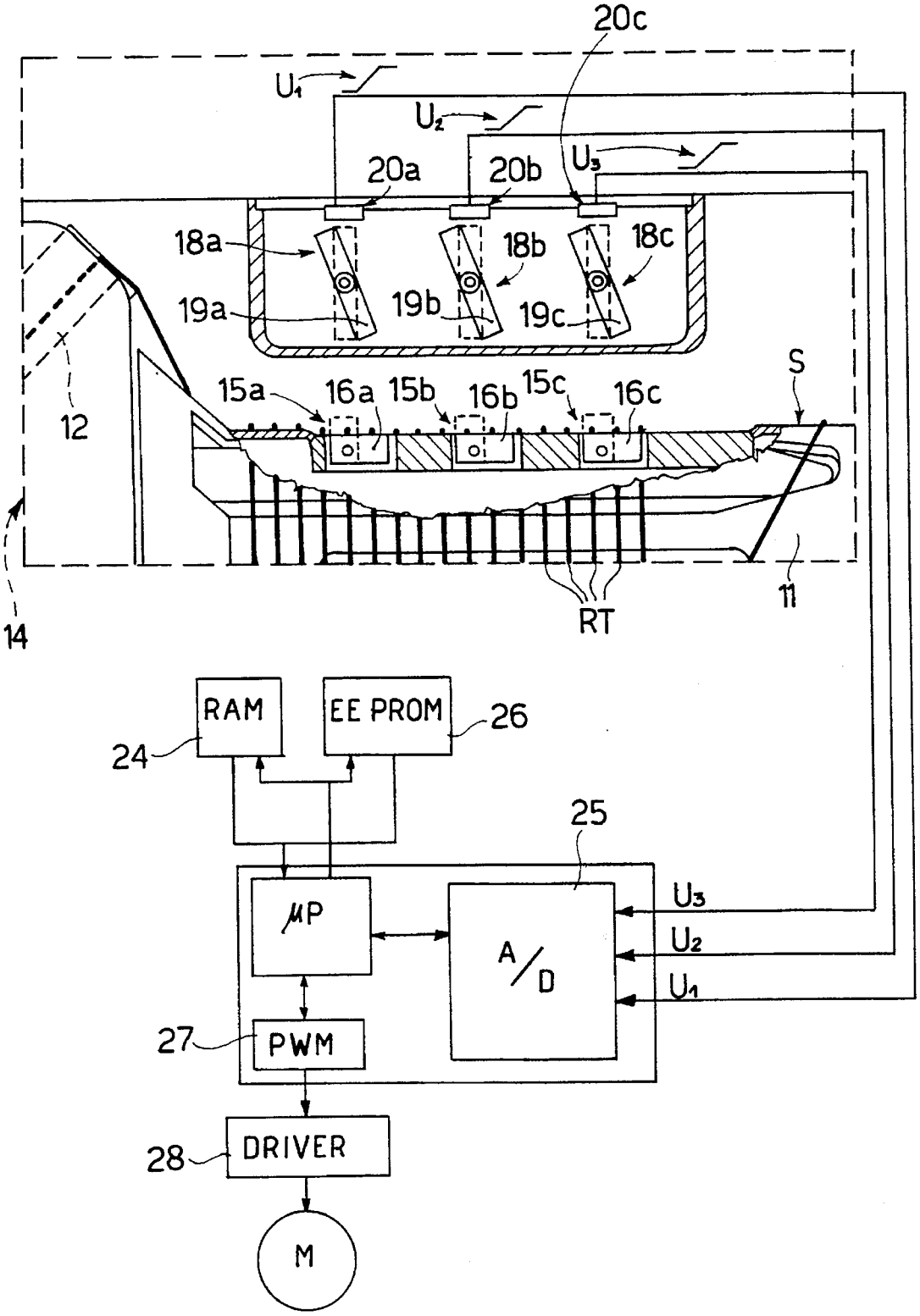
FIG. 2 is an enlarged-scale view of a detail of FIG. 1, illustrating the block diagram of the device for carrying out the improved method according to the invention and its connection to the means for monitoring the weft reserve.

According to the different embodiment of FIG. 2*a*, each plate 19*x* (where x is the subscript of the switch involved), has a circular arc-like reflecting surface 21, the index of reflection whereof varies uninterruptedly between two minimum and maximum values that correspond respectively to the two ends of the surface arc. The beam of light "ri" generated by a source 22*x* is incident to each surface 21*x*, and the beam "rr" reflected by the surface 21*x* is read by a photosensor 23*x* capable of providing an output signal Ux of an analog type that can vary in a linear manner according to the intensity of the reflected beam and therefore according to the angular position of the plate 19*x*.

A microprocessor μP, with which a RAM memory unit 24 is associated, is operatively connected, with the interposition of an analog-digital converter 25, to the outputs of the acquisition sensors 20*x* or 23*x* and receives the voltage signals U1,U2,U3 that are present at the output of said sensors. A second memory unit 26, for example an EEPROM, is also operatively connected to the microprocessor μP and is provided to store, for the self-calibration of the system, characteristic values of the output signals U1,U2,U3, which will be described hereinafter. By means of a modulator 27 of the PWM (Pulse Width Modulator) type and a driver interface 28, the microprocessor μP controls the motor M that drives the shaft 13, starting it to replenish the reserve of weft RT when said reserve drops below the lower limit and disengages the sensor 15*b*, and stopping it when the reserve reaches the maximum value, engaging the sensor 15*c*, and also when, for example due to thread breakage, the sensor 15*a* is also disengaged by the thread.

In order to eliminate the mentioned drawback linked to the unavoidable variations in the alignment of the sensors 16,19,20 (or 23) and in the components of the detectors 18, the microprocessor is based on the acquisition of two characteristic self-learned values of the signals U of said acquisition sensors, as a function whereof it is capable of automatically setting the threshold values for the presence and absence of weft.

For this purpose, according to the invention, a self-calibration method is provided that consists in sensing, when the feeder 10 is not moving and when absolutely no thread is present, the signals $U_1a$,$U_2a$,$U_3a$ that are present at the respective outputs of the detectors 18*a*,18*b*,18*c*. These self-learned values are stored in the memory unit 26. Then the weft thread F is fed to the feeder 10 and the shaft 13 is started and kept at a moderate rotation rate (for example 400–600 rpm). The reserve of weft RT then starts to be wound on the drum 11, and as the reserve increases, the sensors 15*a*,15*b*,15*c* are engaged in succession. The plates 16*a*,16*b*,16*c* of these sensors accordingly vary their position with respect to the surface S of the drum 11 and produce corresponding variations in the signals emitted by the detectors 18*a*,18*b*,18*c*, which assume respective values $U_1p$, $U_2p$, and $U_3p$.

The microprocessor recognizes that the sensor 15*c* has been reached by the reserve RT (and therefore that the reserve has been formed completely) only when the signal $U_3p$ stably remains greater than the signal $U_3a$ read previously for a preset period, for example 100 ms. In this condition, the feeder 10 is stopped, the microprocessor self-detects the three values $U_1p$,$U_2p$,$U_3p$, and stores them in the unit 26. Of course, the values $U_1p$ and $U_2p$ can also be read and stored during the formation of the reserve RT before the feeder 10 stops.

Assuming generically that the signals in the absence of thread are higher than the corresponding signals in the presence of thread, that is to say, assuming that $U_xa>U_xp$ (where x is the subscript of the involved switch), the microprocessor is programmed to decide the threshold $S_ax$ for detecting the absence of weft when the following equation holds for the corresponding value Ux read at the output of each detector:

$$S_ax=U_xp+(1-K)\ (U_xa-U_xp)$$

and to decide the threshold $S_px$ for detecting the presence of weft when:

$$S_p x = U_x p + K\,(U_x a - U_x p)$$

where k is a constant (0<K<1) that is equal to a percentage, for example between 80 and 95%, of the difference between the self-learned and stored maximum and minimum values of the output signals of the detectors 18.

The above described self-calibration method is performed during the initialization of the system at the end of the assembly of the feeder 10 and also, by virtue of the storage of the values $U_x a - U_x p$ in the memory unit 26, if parts of the device are replaced or after generic malfunctions.

Another improvement according to the invention, which is aimed at eliminating the rapid variations of the signals Ux of the switches 18*x* and the consequent instabilities of the weft reserve monitoring system, resides in the fact that an algorithm acting as a filter for the values $U_x$ of the output signals of the detectors 18*x* is implemented on the microprocessor μP.

Starting from the threshold values $S_a x$ and $S_p x$ mentioned above, the following variables are also defined:

Fx=a binary variable, which can assume two values that correspond to the absence of thread and to the presence of thread respectively; it represents the output signal from the filter, on the basis whereof the microprocessor μP starts and respectively stops the motor of the feeder 10;

timexpos( )=time required by the signal Ux to vary in a positive sense;

timexneg( )=time required by the signal Ux to vary in a negative sense.

Figure 3:
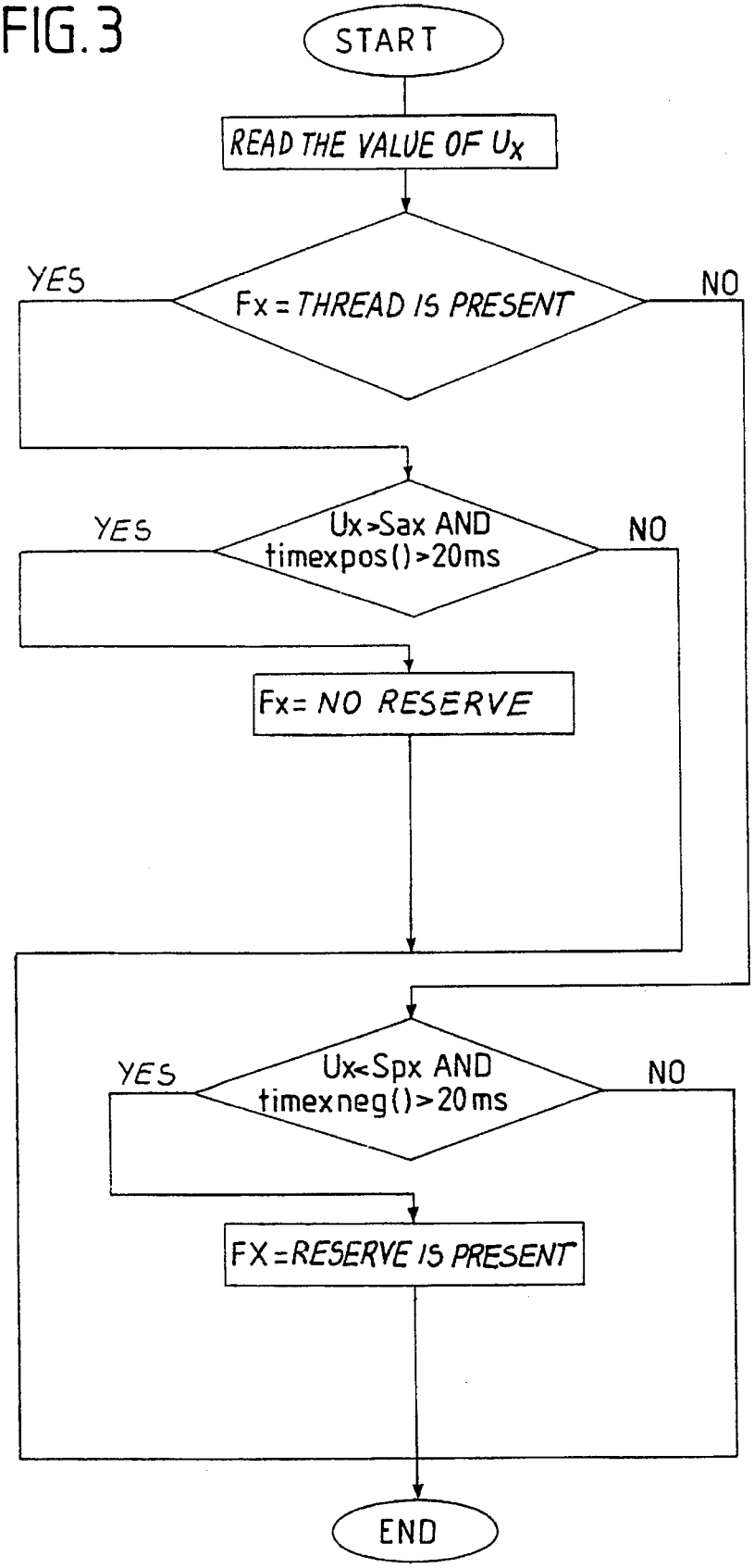
FIG. 3 is a flowchart of the algorithm for filtering the signals produced by said monitoring means, shown in FIGS. 2 and 2*a*.

With the specified variables and with reference to the flowchart of FIG. 3, the filtering of the signals Ux for the specified purpose is performed by the microprocessor μP by performing the following algorithm periodically, for example every millisecond:

a) acquisition of the value Ux of the signal of the detector 18*x* involved;

b) checking of the presence or absence of the thread, sensed from the value of Fx;

c) if thread is present, checking of the inequalities $Ux > S_a x$ and timexpos( )>τ; where τ is for example 20 ms. A positive result is interpreted as meaning that the reserve is not present.

d) if thread is not present, checking of the inequalities $Ux < S_p x$ and timexneg( )>τ. A positive result is interpreted as meaning that a reserve is present.

The stability of the described system can be further increased by complementing the value to the variable Fx only if the value of the signal Ux exceeds the value of the threshold and remains above it for a preset period of time.

According to a different embodiment of the invention, the signal Ux that is present at the output of the acquisition sensors 20*x* or 23*x* is preprocessed with a digital low-pass filter on the basis of the current value of the read voltage signal Ux and of n values of said signal previously sampled; the value of n (a whole number) depends on the type and complexity of the filter being used.

The structure of the digital low-pass filter is not described in detail, since it is known to the person skilled in the art and is in any case described extensively in the literature, for example in the publication "Digital Signal Processing", by A. V. Oppenheim and R. W. Shafer, Prentice-Hall, 1975.

A signal $Uf_x$, in which rapid variations have been substantially filtered out, is present at the output of said digital filter. Therefore, by taking the signal $Uf_x$ as reference and by accurately setting the cutoff frequency and the rolloff of said filter, it is possible to avoid checking the inequalities timexpos( )>τ and timexneg( )>τ in the algorithm of FIG. 3, so that said algorithm is simplified as follows:

a) reading of the signal Ux b) calculation of the signal $Uf_x$ c) checking of the presence or absence of thread, determined from the value of Fx d) if thread is present: if $Uf_x > Sa_x$, then no weft is present;

e) if thread is not present: if $Uf_x < Sp_x$, then weft is present.

However, the above different embodiment of the invention, which is advantageous in terms of simplification of the filtering algorithm, requires the use of particularly fast microprocessors, possibly of the DSP (Digital Signal Processor) type and preferably with 32-bit registers, in order to perform preventive digital filtering of the signal Ux in a reasonable time, for example 100–200 microseconds for all three sensors 20 or 23, whereas the algorithm shown in the flowchart of FIG. 3 can be easily implemented by microprocessors having 8-bit registers.

Without altering the principle of the invention, the details of the execution of the device and the embodiments of the methods for self-calibration and filtering of the switching signals can of course be altered extensively with respect to what is described and illustrated by way of non-limitative example without thereby abandoning the scope of the invention defined by the appended claims.

What is claimed is:

1. A device for monitoring the reserve (RT) of thread in weft feeders (10) having a fixed drum (11) and a motor (M), comprising weft sensors (15*x*) that are constituted by magnetic elements (16*x*) mounted in the fixed drum (11) of the feeder (10) so as to be movable between a first position, which protrudes beyond the surface (S) of the drum, and a second position, at the same level as said surface, and in which each weft sensor (15*x*) cooperates with a respective detector (18*x*) that is located outside the drum (11), said detector reacting with a signal, without contact, when the position of the corresponding magnetic element of the weft sensor changes; wherein each detector in turn comprises an acquisition sensor (20*a*–23*x*) for providing an analog signal, in terms of voltage (Ux), that can vary in a linear manner as the angular positions of the movable magnetic element (16*x*) of the corresponding weft sensor (15*x*) vary, and in that said acquisition sensors are operatively connected to a microprocessor (μP) for controlling the motor (M) of the feeder (10), said microprocessor comprising value setting means and processing means, said value setting means automatically setting the values of a weft presence threshold ($S_p x$) and of a weft absence threshold ($S_a x$) when the values of the analog signal (Ux) are greater than the minimum signal ($U_x p$) increased by a preset percentage (K and respectively 1–K) of the difference ($U_x a - U_x p$) between maximum and minimum values of said signal, and said processing means processing, with an algorithm, the analog signals (Ux) in order to filter out the rapid variations of said analog signals.

2. A device according to claim 1, characterized in that the sensors (20*x*) are constituted by Hall magnetic sensors adapted to provide analog signals ($U_x$) that can vary in a linear manner and proportionally to the intensity of the magnetic field that is incident on their surface; said magnetic field being produced by oscillating magnetic plates (19*x*) that interact with the corresponding movable magnetic elements (16*x*) of the weft sensors (15*x*).

3. A device according to claim 1, wherein each one of the acquisition sensors (23*x*) is constituted by a reflecting surface (21*x*) that is shaped like a circular arc and is supported by an oscillating magnetic plate (19*x*) that interacts with the movable magnetic element (16*x*) of the corresponding weft sensor (15*x*); in that the reflecting surface (21*x*) has an index of reflection that can vary continuously between two minimum and maximum values that correspond respectively to the two ends of the arc of the surface; in that a light beam (ri) produced by a corresponding source (22*x*) is incident to each surface; and in that the beam (rr) reflected by the surface (21*x*) is read by a corresponding acquisition photosensor (23*x*) for providing an analog output signal (Ux) that can vary in a linear manner according to the intensity of the reflected beam.

4. A device according to claim 1, wherein the microprocessor (μP) is operatively connected to outputs of the acquisition sensors (20*x*–23*x*) with the interposition of analog/digital converters (25), said microprocessor driving the motor (M) of the feeder (10) by means of a modulator (27) and a driver interface (28).

5. A device according to claim 1, comprising a memory unit (26) of the EEPROM type connected to said microprocessor (μP) and adapted to store, for the self-calibration of the control system, self-learned values ($U_x$a–$U_x$p) of the signals of the acquisition sensors corresponding to the first position and to the second position of the movable elements (16*x*) of the weft sensors (15*x*), said first position corresponding to the absence of the thread and said second position corresponding to the presence of the thread.

6. An improved method for monitoring the reserve of thread in weft feeders (10) that comprise the device according to anyone of the preceeding claims, wherein said method comprises the steps of:

detecting and storing the values ($U_x$a, $U_x$p) of the sensor signals emitted by the acquisition sensors (20*x*, 23*x*) respectively in the absence and in the presence of thread, and setting the thread absence threshold ($S_a$x) and the thread presence threshold ($S_p$x) by setting, for a first threshold:

$$S_a x = U_x p + (1-K)\,(U_x a - U_x p)$$

and for a second threshold:

$$S_p x = U_x p + K\,(U_x a - U_x p)$$

where $S_a$X=the threshold for detecting the absence of weft $S_p$X=the threshold for detecting the presence of weft $U_x$p=the value of the sensor signal emitted by the acquisition sensor (23*x*) in the presence of the thread $U_x$a=the value of the sensor signal emitted by the acquisition sensor (20*x*) in the absence of the thread, $U_x$a being greater than $U_x$p and K being a constant comprised between 0 and 1.

7. A method according to claim 6, wherein said sensor signals (Ux) emitted by the acquisition sensors (20*x*, 23*x*) are filtered, to eliminate rapid variations of said signals, by carrying out the steps of:

acquiring the value of the sensor signal (Ux);

checking the presence or absence of the thread (Fx yes-no);

if thread is present, checking of the inequalities Ux>$S_a$x and timexpos( )>; a positive result meaning that the reserve is not present;

if thread is not present, checking of the inequalities Ux<$S_p$x and timexneg( )>; a positive result meaning that a reserve is present;

being a time comprised between 15 and 30 ms, timexpos( ) being the time required by the signal (Ux) to vary in a positive sense, timexneg( ) being the time required by the signal (Ux) to vary in a negative sense.

8. A method according to claim 7, comprising operating the microprocessor (μP) periodically to carry out the filtering steps.

9. A method according to claim 8, wherein said microprocessor (μP) controls the starting and respectively the stopping of the motor of the feeder (10) depending on the value of a binary function (Fx) that represents the useful signal produced by the filtering steps.

10. A method according to claim 6, comprising digitally filtering the sensor signals (Ux) emitted by the acquisition sensors (20*x*,23*x*) to produce signals ($Uf_x$) from which rapid variations of said signals are filtered out by:

acquiring the value of the sensor signal (Ux);

checking the presence or absence of the thread (Fx yes-no);

if thread is present, checking of the inequality Ux>$S_a$x; a positive result meaning that the reserve is not present;

if thread is not present, checking of the inequality Ux<$S_a$P; a positive result meaning that a reserve is present.

11. A method according to claim 10, wherein a low-pass digital filter carries out, on the basis of the current value (Ux) of the read signal and of n values of the read signal previously sampled, the digital filtering of the signals (Ux) read at the output of the acquisition sensors (20*x*–23*x*).

* * * * *